US009334152B2

(12) United States Patent
James

(10) Patent No.: US 9,334,152 B2
(45) Date of Patent: May 10, 2016

(54) SADDLE STIRRUP

(71) Applicant: Alex James, Abilene, KS (US)

(72) Inventor: Alex James, Abilene, KS (US)

( * ) Notice: Subject to any disclaimer, the term of this patent is extended or adjusted under 35 U.S.C. 154(b) by 179 days.

(21) Appl. No.: 14/221,920

(22) Filed: Mar. 21, 2014

(65) Prior Publication Data

US 2015/0068168 A1 Mar. 12, 2015

(51) Int. Cl.
*B68C 3/00* (2006.01)

(52) U.S. Cl.
CPC ..... *B68C 3/00* (2013.01); *B68C 2003/0083* (2013.01)

(58) Field of Classification Search
CPC ..... B68C 3/00; B68C 2003/0083; B68C 2003/0025; B68C 3/0016
USPC ..... 54/47, 49, 49.5, 48
See application file for complete search history.

(56) References Cited

U.S. PATENT DOCUMENTS

| | | | | |
|---|---|---|---|---|
| 21,764 | A | 10/1858 | Iversen | |
| 33,930 | A * | 12/1861 | Eagle | B68C 3/00 54/47 |
| 38,995 | A * | 6/1863 | Torrers | B68C 3/00 54/47 |
| 169,209 | A | 10/1875 | Wagstaff | |
| 459,291 | A | 9/1891 | Johnson et al. | |
| 756,270 | A | 4/1904 | McVey | |
| 1,991,648 | A | 2/1935 | Armentrout | |
| 5,123,233 | A | 6/1992 | Majewski | |
| 5,172,538 | A | 12/1992 | Luger | |
| 5,398,488 | A | 3/1995 | Brown | |
| 5,930,986 | A | 8/1999 | Meaghan et al. | |
| 6,220,004 | B1 | 4/2001 | Hsi-Chang | |
| 6,568,940 | B2 | 5/2003 | Mack | |
| 6,651,409 | B2 | 11/2003 | Jones | |
| 7,222,473 | B2 | 5/2007 | Jones | |
| 7,469,523 | B2 | 12/2008 | Hussey | |
| 7,487,627 | B2 | 2/2009 | Godoy | |
| 8,240,113 | B2 | 8/2012 | Warson et al. | |

FOREIGN PATENT DOCUMENTS

DE 2123071 A1 * 12/1971 ..... B68C 3/00

* cited by examiner

*Primary Examiner* — Lisa Tsang
(74) *Attorney, Agent, or Firm* — Erickson Kernell Derusseau & Kleypas, LLC

(57) ABSTRACT

A stirrup for saddles. The stirrup includes a pair of side members that extend upwardly from opposing sides of a tread. The tread is provided with a forwardly and downwardly slanted orientation. The orientation of the tread places a rider's foot in a heels-up position in which the rider's heel is above the toes. The heels-up position may be beneficial to professional and experienced riders participating in rodeo events like team roping, barrel racing, or other events in which the rider benefits from being in a forward position over or in front of the saddle. A cross-member extends between upper ends of the side members in a non-parallel orientation relative to the tread. The orientation of the cross-member causes the bottom end of the stirrup to list toward the animal to provide a rider with a more natural position when standing in the stirrups.

15 Claims, 4 Drawing Sheets

SADDLE STIRRUP

BACKGROUND

Stirrups have long been used with saddles for riding horses. Stirrups provide a rider with an aid for mounting and maintaining a mount on the animal to be ridden as well as assisting the rider in controlling the animal. The configuration of stirrups can vary based on the intended use or style of riding, such as English riding, Western riding, rodeo, and racing, which are not mutually exclusive.

Various types and configurations of stirrups have been developed to promote a heals-down position, which is generally understood to be the standard riding position for most disciplines. The heals-down riding position is commonly understood to be with the rider's foot positioned to angle upwardly with the toes above the heel and with the ball of the foot on the footrest or tread of the stirrup. This position provides the rider with a comfortable and confident foot position that allows the rider to stand in the stirrups or sit in the saddle. The heals-down position also aids to reduce any risk of entanglement between the rider's foot and the stirrup if a rider falls from his or her mount.

Exemplary stirrups include, U.S. Pat. No. 5,172,538 to Luger which describes a stirrup pad that provides an inclined footrest to aid a user in maintaining a heals-down foot orientation to produce a more comfortable and more stylish riding position. U.S. Pat. No. 21,764 to Loudon describes a stirrup with a pivoting footrest that is configured to pivot rearwardly to ease withdrawal of the rider's foot. Similarly, U.S. Pat. No. 5,930,986 to Meaghan et al. describes saddle stirrups that have a pivoting footrest to ease mounting and dismounting and to accommodate an angle of a rider's foot in a proper heels down-toes up position.

U.S. Pat. No. 459,291 to Johnson et al. depicts a stirrup with an open side that allows the rider's foot to exit the stirrup laterally. And U.S. Pat. No. 7,222,473 to Jones describes a stirrup with a footrest that is slanted downward toward an outer side of the stirrup to improve comfort for the rider.

These and other known stirrups may aid to increase comfort in many standard riding conditions, but applications exist in which non-standard riding positions may be beneficial. For example, rodeo events including team roping, also referred to as heading and heeling, and barrel racing involve professional or highly experienced riders and horse sprinting to catch a steer or sprinting around a pattern of barrels. In such instances, it may be beneficial for the rider to retain his or her center of gravity forward on the horse so as to hinder the horse's performance as little as possible while also staying in position to rope the steer or to guide the horse throughout the run. This forward position of the rider is difficult or impossible to achieve and/or maintain with a heals-down foot position and with stirrups that promote the heals-down position. Further, use of stirrups configured for heals-down riding when attempting to achieve or maintain the forward riding position may increase the likelihood of the rider losing a stirrup among other potential safety concerns.

To maintain the forward position, the rider may benefit from a heals-up riding position in which the heels are above the toes to place the foot in a forwardly tilted orientation. Such a non-standard position can be difficult and dangerous to achieve and/or maintain using known stirrup configurations. There is thus a need for a stirrup that provides riders, such as professional riders and experienced rodeo competitors with a heals-up riding position.

SUMMARY

Embodiments of the invention are defined by the claims below, not this summary. A high-level overview of various aspects of the invention are provided here for that reason, to provide an overview of the disclosure, and to introduce a selection of concepts that are further described in the Detailed-Description section below. This summary is not intended to identify key features or essential features of the claimed subject matter, nor is it intended to be used as an aid in isolation to determine the scope of the claimed subject matter. In brief, this disclosure describes, among other things, stirrups for saddles, namely saddles for team roping, barrel racing, and similar events in which the rider benefits from being in a forward riding position.

The stirrups include an upwardly opening, U-shaped body comprised of a pair of upright, planar, side members and a tread extending between lower ends thereof. A dowel or similar cross-member extends between upper ends of the side members and receives a strap or stirrup leather for coupling the stirrup to a saddle. The dowel is positioned at an angle with respect to the tread to allow the bottom end of the stirrup to lean toward the animal. This lean places the tread at a natural and comfortable angle for the rider's foot and may allow the stirrup to follow the contour of the animal's sides.

The tread is provided with a forward and downwardly angled orientation that places a rider's foot in a heals-up downwardly angled orientation with the rider's toes positioned below the heel. The rider is thus provided with a more natural foot position for maintaining a weight-forward riding position.

DESCRIPTION OF THE DRAWINGS

Illustrative embodiments of the invention are described in detail below with reference to the attached drawing figures, and wherein.

DETAILED DESCRIPTION

The subject matter of select embodiments of the invention is described with specificity herein to meet statutory requirements. But the description itself is not intended to necessarily limit the scope of claims. Rather, the claimed subject matter might be embodied in other ways to include different components, steps, or combinations thereof similar to the ones described in this document, in conjunction with other present or future technologies. Terms should not be interpreted as implying any particular order among or between various steps herein disclosed unless and except when the order of individual steps is explicitly described.

With reference to FIGS. 1-4, a stirrup 10 for coupling to a saddle for riding an animal, such as a horse, is described in accordance with an embodiment of the invention. The stirrup 10 is described herein with respect to horse riding and saddles for horses, however the stirrup can be employed with saddles for riding any type of animal that is ridden for sport, transportation of people or goods, or operation of equipment like plows among others. The stirrup 10 is preferably employed by professional and/or experienced riders for sporting or rodeo events like team roping, i.e. heading and heeling, and barrel racing, but the stirrup 10 can be employed in other sport or non-sport related uses. The stirrup 10 may be particularly useful in instances or events in which the rider wishes to achieve and maintain a forward position over and/or in front of the saddle.

Figure 3:
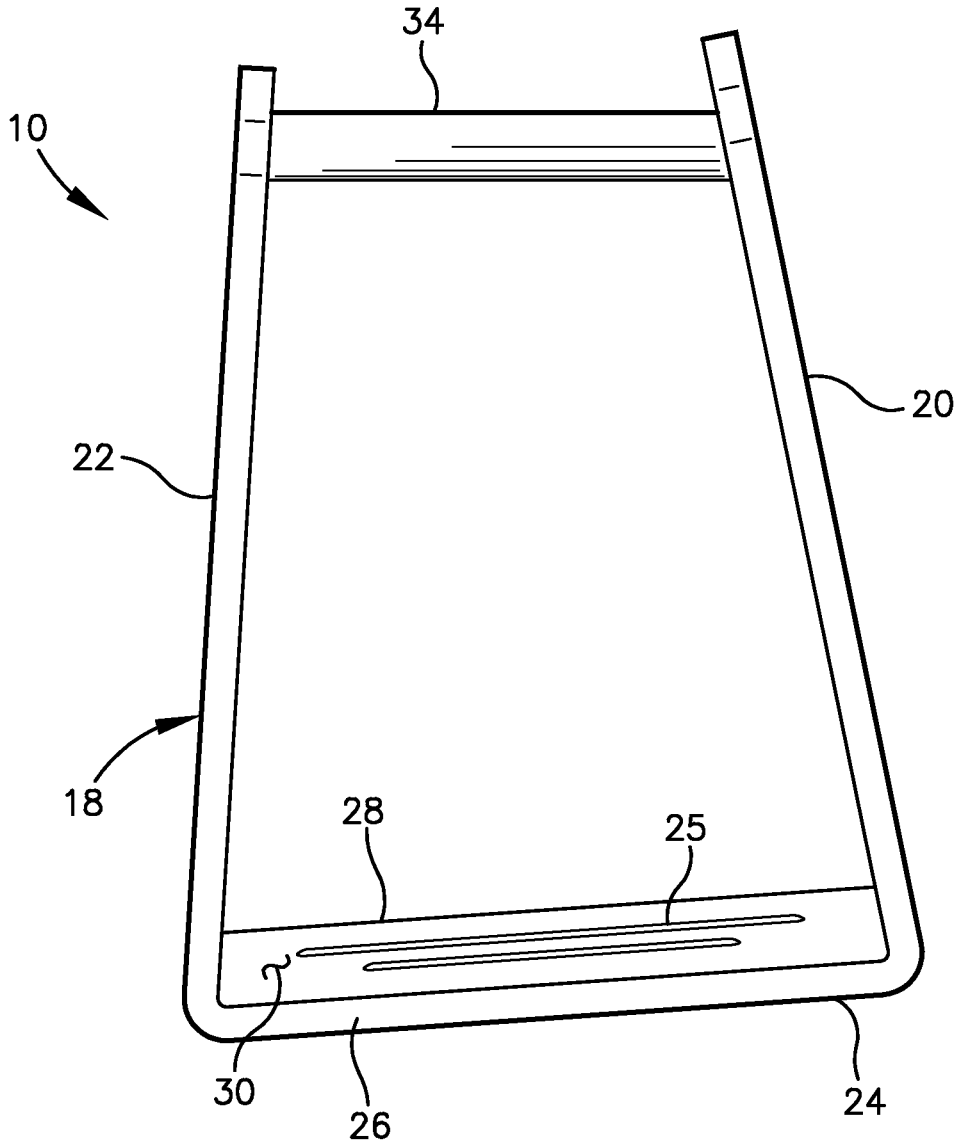
FIG. 3 is a front-side elevational view of the stirrup of FIG. 2.
Figure 4:
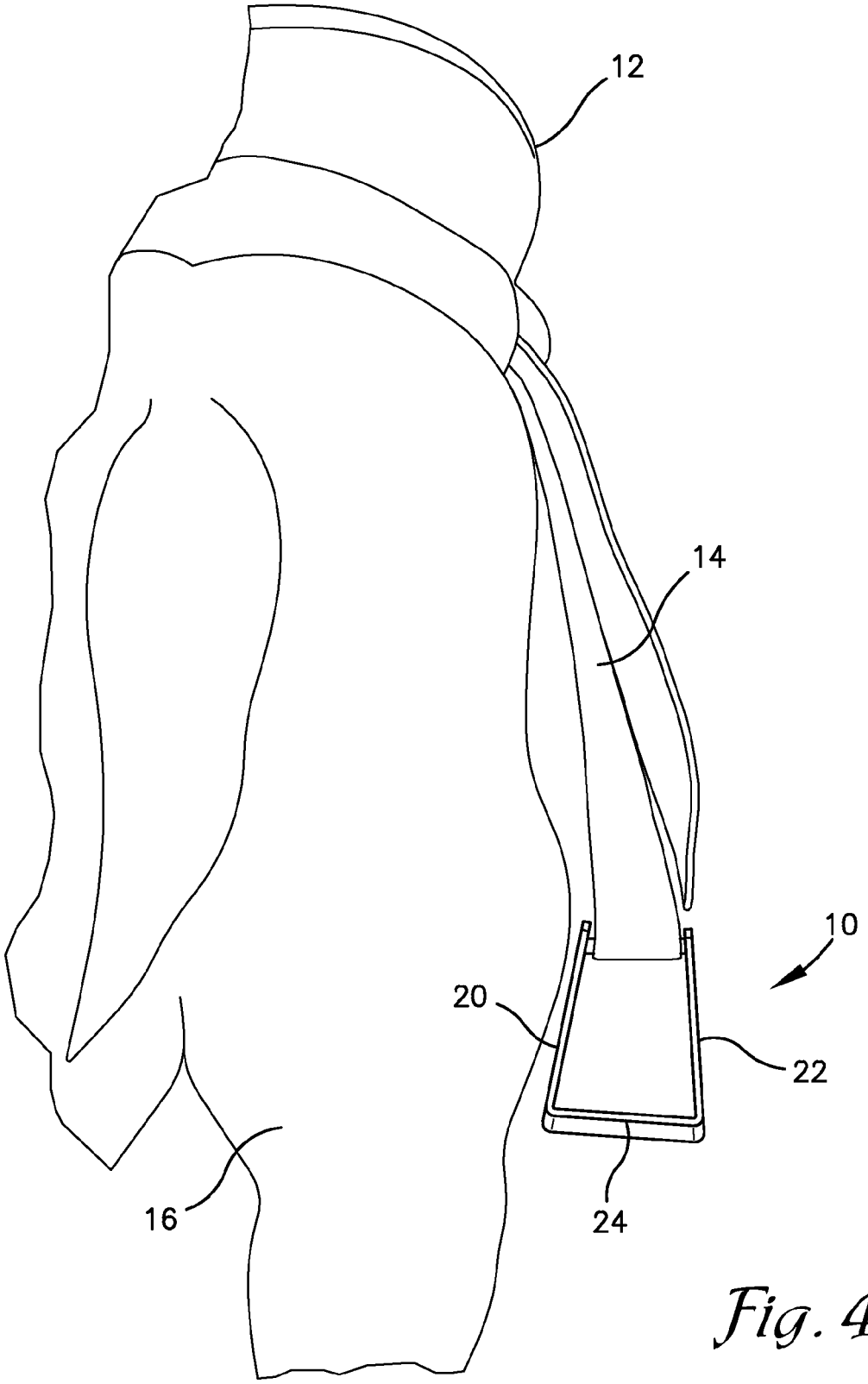
FIG. 4 is a backside elevational view of the stirrup of FIG. 2 disposed to hang from a saddle alongside a horse in accordance with an embodiment of the invention.

As is known in the art, the stirrups 10 are used in pairs; one stirrup coupled to each side of a saddle 12 by a strap or stirrup leather 14 to hang alongside each side of an animal 16 to be ridden, as depicted in FIG. 4. Only a single stirrup 10 configured for use as a right-side stirrup, e.g. for the right foot of the rider, is depicted in FIGS. 1-4, but it is to be understood that a left-side stirrup would also be employed by a rider and would be a mirror image of the right-side stirrup 10.

The stirrup 10 includes a generally U-shaped body 18 comprised of a pair of side members 20, 22 and a tread 24 extending between lower ends of the side members 20, 22. The side members 20, 22 include an inside member 20 that is positioned nearest to the animal 16 and an outside member 22 positioned outside of a rider's foot 29 and away from the animal 16. The side members 20, 22 are spaced apart a first distance at their lower ends by the tread 24 and slant inwardly toward one another toward their upper ends such that the upper ends are spaced apart a second distance that is less than the first distance. The side members 20, 22 can slant inwardly at equal angles or one side member 20 may slant inwardly more or less than the other side member 22. In another embodiment, the side members 20, 22 can be positioned parallel to one another. As depicted in FIGS. 1-4, the side members 20, 22 are provided as planar sections of a plate-like material but may be formed from one or more bars, rods, or other material shapes arranged in a similar orientation to the tread 24.

Figure 2:
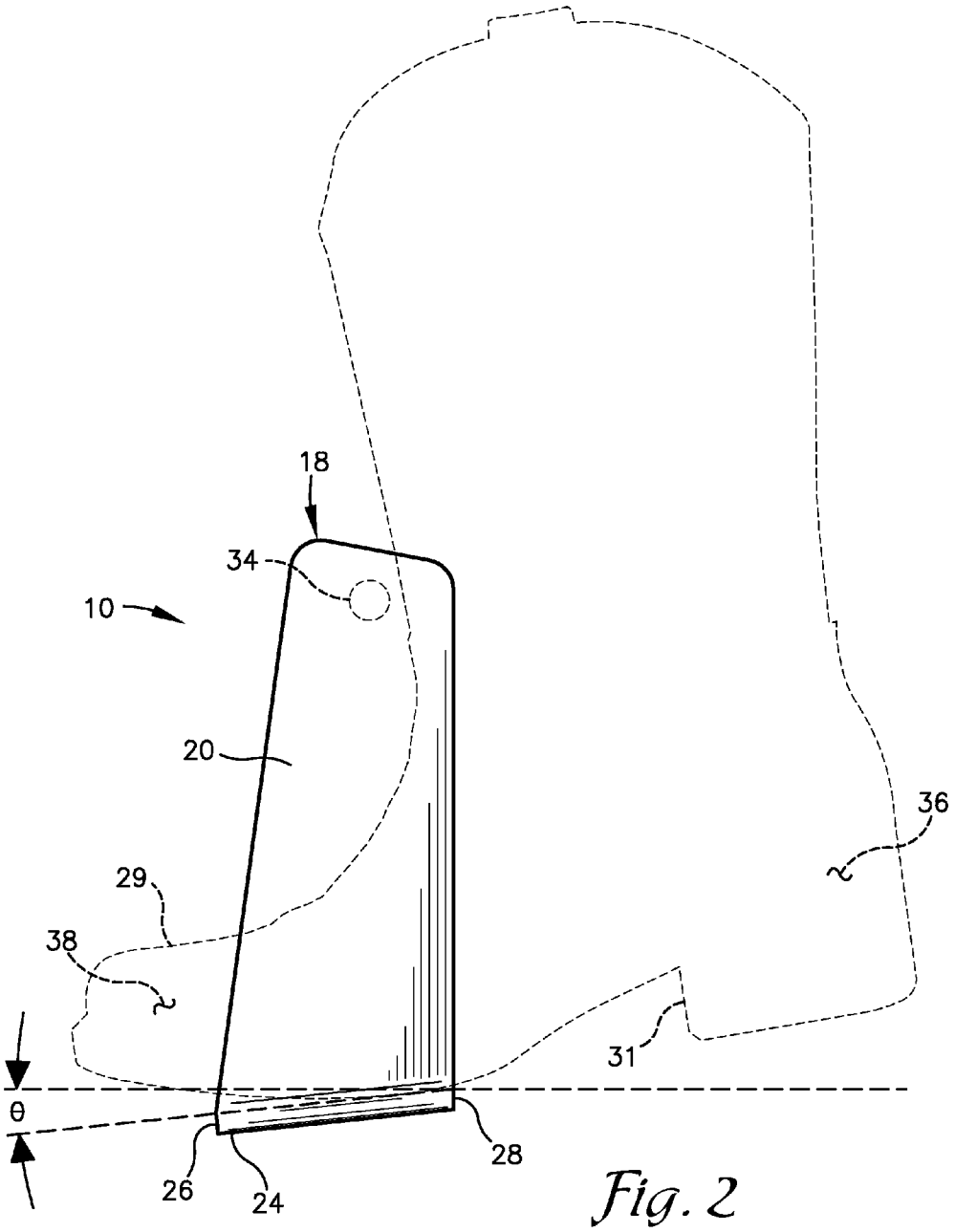
FIG. 2 is a side elevational view of a stirrup with a forwardly and downwardly slanting tread for use with a right foot of a rider depicted in accordance with an embodiment of the invention.

The tread 24 extends between the lower ends of the side members 20, 22 and is disposed at a forwardly and downwardly leaning angle θ, e.g. a front edge 26 of the tread 24 that is closest to the head of the horse is lower than a rear edge 28, as best shown in FIG. 2. The angle θ is between about 3° and about 45°, or preferably between about 5° and about 25°, or more preferably between about 10° and about 20°. In one embodiment, the angle θ is about 15°. The term "about" or "approximately" as used herein means deviations from the exact value by +/−10%, preferably by +/−5% and/or deviations in the form of changes that are insignificant for the function.

The tread 24 is configured as a generally planar member having dimensions suitable to receive a rider's foot, shoe, or boot (hereinafter referred to collectively as the rider's foot 29) thereon and between the side members 20 and 22. The foot 29 is preferably received such that the ball of the foot is positioned over the tread 24. When wearing boots or other footwear with a downwardly extending heel 31, engagement between the heel 31 and the rear edge 28 of the tread 24 preferably resists or prevents passage of the foot 29 completely through the stirrup 10.

The width of the tread 24 between the side members 20, 22 may be variable with respect to a size of a rider's foot such that an appropriately sized stirrup 10 can be selected based on an individual rider. In general, the width is preferably equal to or less than approximately one inch larger than the widest part of a rider's foot so as to allow the rider to easily insert and withdraw the foot from within the stirrup 10. Smaller or larger widths can be employed as desired by a rider without departing from the scope of embodiments of the invention described herein.

The length of the tread 24 between the front and rear edges 26, 28 is sufficient to provide a platform on which to support the foot 29 of the rider. The length of the tread 24 and of the sidewalls 20, 22 may be configured to resist passage of the rider's foot 29 through the stirrup 10; a greater length may resist or obstruct passage of the foot 29 through the stirrup 10. In an embodiment, the length of the tread 24 is between approximately one and five inches or more preferably approximately three inches.

In some embodiments, the a top surface 30 of the tread 24 may be provided with one or more protuberances, grooves, coatings, layers, wraps, or other features 25 to enhance traction between the rider's foot and the tread 24. The features can increase traction or friction between the rider's foot 29 and the tread 24 to resist slipping or withdrawal of the foot 29 from the stirrup 10 or the features may decrease friction to enable easier withdrawal of the foot 29 from the stirrup 10.

The body 18 of the stirrup 10 is constructed from one or more light-weight, high-strength metals, such as for example aluminum, titanium, or steel alloys, but can be constructed from any available metals or other materials including plastics, composites, wood, laminates, or the like. As depicted in FIGS. 1-4, the body 18 can be formed from an elongate plate that is bent or otherwise formed to provide the side members 20, 22 and the tread 24. However, the body 18 might also be formed as a single component by, for example, molding or casting, or formed by assembling a plurality of separate components, such as by welding or using fasteners, among a variety of other methods.

Figure 1:
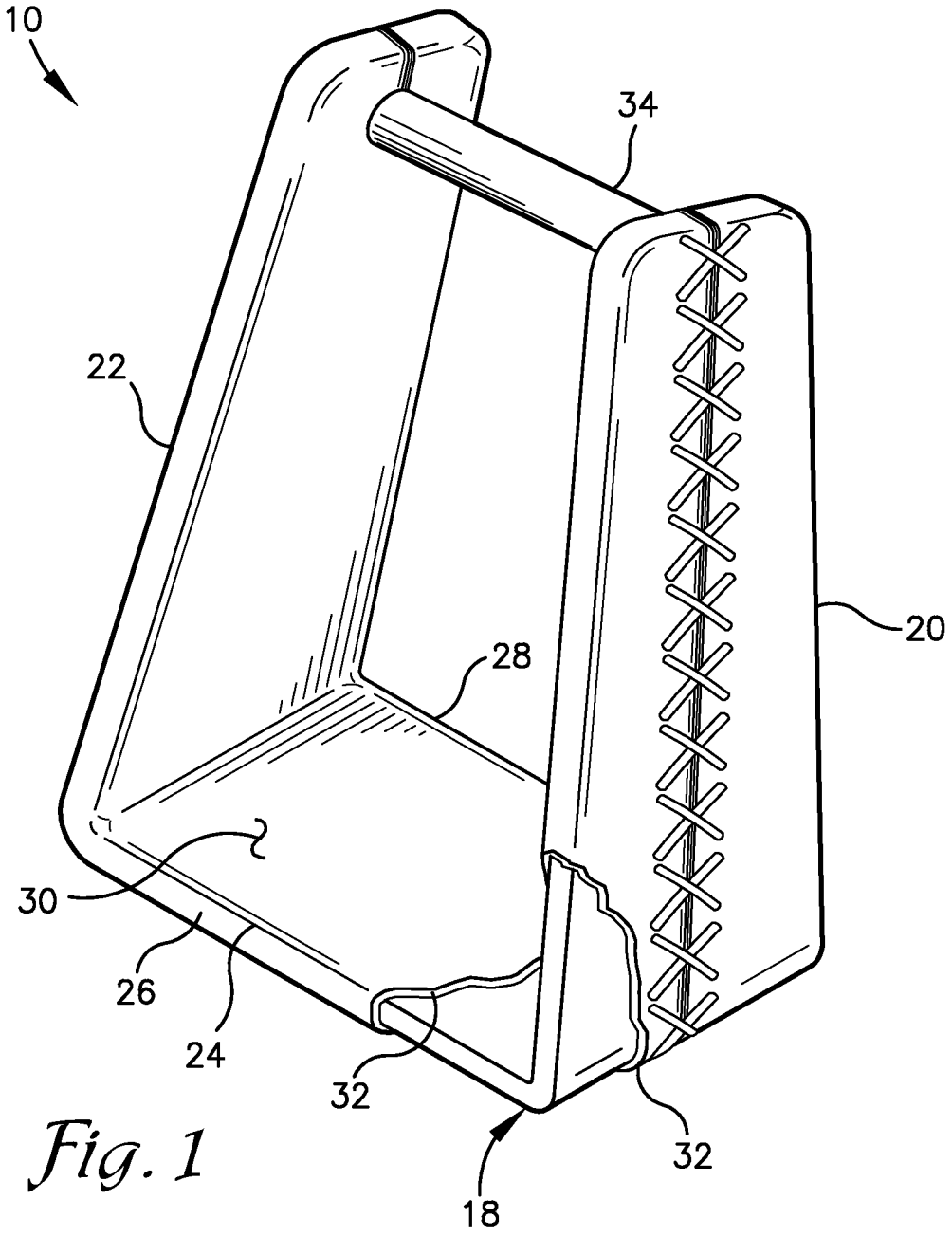
FIG. 1 is a perspective view of a stirrup showing a partial cutaway of a material in which the stirrup is encased depicted in accordance with an embodiment of the invention.

As depicted in FIG. 1, the body 18 may be covered or encased in an outer casing 32. The outer casing 32 can comprise a material like a leather, rubber, plastic, paint, or vinyl, among others, that is wrapped around the body 18 or coated on the body 18, such as by dipping, painting, or powder coating. The casing 32 may cover all or only a portion of the body 18 and is employed to impart an attractive aesthetic appearance and/or to enhance the traction between the rider's foot and the tread 24 as described previously.

A dowel or cross-member 34 is disposed to extend between upper ends of the side members 20, 22 at a non-parallel orientation relative to the tread 24. The cross-member 34 is a generally cylindrical member but can take any desired form suitable for receiving a strap, stirrup leather 14, or other member for coupling to the saddle 12. The cross-member 34 is comprised of the same or dissimilar material to the body 18 and is fixedly or removeably coupled thereto.

As depicted in FIGS. 3 and 4, an outside end of the cross-member 34 couples to the outside member 22 near a top end thereof at a first distance from the tread 24. An inside end of the cross-member 34 couples to the inside member 20 at a second distance from the tread 24 that is less than the first distance. The cross-member 34 thus slopes downwardly toward the tread 24 as it extends from the outside member 22 toward the inside member 20. Such an orientation provides the stirrup 10 with a skewed hanging position when suspended from stirrup leather 14, as depicted in FIG. 4. In the skewed hanging position, the bottom end of the stirrup 10 lists toward the animal's body and places the tread 24 in a slightly downward angle as the tread 24 extends from the inside member 20 toward the outside member 22. The skewed hanging position thus biases the stirrup 10 toward the animal's body and may follow the contours of the animal's body. And the downward, side-to-side angle imparted to the tread 24 may increase a rider's comfort by providing a more natural orientation for the rider's foot when engaged with the stirrup 10.

In use, the stirrup 10 is attached to the saddle 12 via the stirrup leather 14 and is suspended alongside a horse's body 16. A rider mounted in the saddle 12 inserts a foot 29 into the stirrup 10 between the side members 20, 22 and preferably places the ball of the foot on the tread 24. Some riders may prefer other foot positions. For example, a rider may prefer to insert the foot 29 into the stirrup 10 a sufficient distance to place a downwardly extending heel 31 of the rider's boot into contact with the rear edge 28 of the tread 24.

No matter the extent to which the foot 29 is inserted through the stirrup 10, engagement of the foot 29 with the tread 24 places the foot 29 in a heels-up position in which the heel 36 of the foot 29 is above the toes 38. As the rider presses downwardly with his or her feet 29 to support him or herself on the stirrups 10, the forward and downward angle of the tread 24 brings the rider forward in or over the saddle 12 and/or provides the rider with a more natural foot 29 position to allow the rider to assume a forward position in or over the saddle 12. In the forward position, the rider can properly support him or herself on the animal 16 when the animal 16 is quickly accelerating and/or sprinting while also minimizing the rider's hindrance of the animal's movements. The forward position may also be beneficial for the rider in preparing to rope a steer or perform other similar activities.

The heels-up position provided by the stirrup 10 may also reduce the likelihood of a rider loosing the stirrup 10 while riding, e.g. unintentionally withdrawing the foot 29 from the stirrup 10. The forward and downward angle of the tread 24 maintains the foot forward on the tread 24 and resists the foot sliding rearwardly while riding.

In the event of the horse 16 falling, the construction of the stirrup 10 of a high-strength plate material may protect the rider's foot 29 from injury. The stirrup 10 preferably has sufficient strength to at least partially resist crushing under the animal's weight. As such, the stirrup 10 may prevent at least a portion of the animal's weight from being applied on the rider's foot 29. The broad planar side members 20, 22 of the body 18 may also aid to resist binding or entanglement of the foot 29 with the stirrup 10 by providing broad, smooth surfaces along which the foot 29 can slide without out obstruction.

Many different arrangements of the various components depicted, as well as components not shown, are possible without departing from the scope of the claims below. Identification of structures as being configured to perform a particular function in this disclosure and in the claims below is intended to demarcate those structures as including a plurality of possible arrangements or designs within the scope of this disclosure and readily identifiable by one of skill in the art to perform the particular function in a similar way without specifically listing all such arrangements or designs. Embodiments of the technology have been described with the intent to be illustrative rather than restrictive. Alternative embodiments will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

What is claimed is:

1. A stirrup for a saddle, the stirrup comprising:

an inside member;

an outside member, the inside member being nearer to an animal's body than the outside member when coupled to a saddle that is installed on the animal's body; and a tread extending between the inside member and the outside member, the tread having a rear edge and a front edge, the front edge being nearer to a head of the animal's body when coupled to the saddle that is installed on the animal's body, the tread extending from the rear edge toward the front edge at a downwardly sloping angle.

2. The stirrup of claim 1, wherein the downwardly sloping angle of the tread is configured to position toes of a rider's foot vertically lower than a heel of the foot when the rider's foot is engaged on the tread.

3. The stirrup of claim 1, wherein the downwardly sloping angle is between about 10 degrees and about 20 degrees.

4. The stirrup of claim 3, wherein the downwardly sloping angle is about 15 degrees.

5. The stirrup of claim 1, wherein the tread is a planar member.

6. The stirrup of claim 1, further comprising:

a casing covering at least a portion of the stirrup.

7. The stirrup of claim 1, further comprising:

a cross-member extending between the inside member and the outside member, the cross-member having a first end coupled to the inside member at a first distance from the tread and a second end coupled to the outside member at a second distance from the tread, the first distance being less than the second distance.

8. The stirrup of claim 7, wherein the stirrup is suspended from a strap that is coupled to the cross-member, the strap coupling the stirrup to the saddle, and when suspended from the strap, a bottom end of the stirrup lists toward a second similarly configured stirrup suspended from a second strap coupled to an opposite side of the saddle.

9. The stirrup of claim 1, wherein the tread includes one or more traction features on a top surface thereof.

10. A stirrup for a saddle, the stirrup comprising:

a planar, inside member;

a planar, outside member, the inside member being nearer to a body of an animal than the outside member when coupled to a saddle that is installed on the animal, top ends of the inside and outside members being spaced apart a shorter distance than bottom ends of the inside and outside members;

a planar tread extending between the inside member and the outside member, the tread having a rear edge and a front edge, the front edge being nearer to a head of the animal when coupled to the saddle that is installed on the animal's body, the tread extending from the rear edge toward the front edge at a downwardly sloping angle, the downwardly sloping angle configured to position toes of a rider's foot vertically lower than a heel of the foot when the rider's foot is engaged on the tread; and a cross-member extending between the inside member and the outside member, the cross-member having a first end coupled to the inside member at a first distance from the tread and a second end coupled to the outside member at a second distance from the tread, the first distance being less than the second distance.

11. The stirrup of claim 10, wherein the downwardly sloping angle is between about 10 degrees and about 20 degrees.

12. The stirrup of claim 11, wherein the downwardly sloping angle is about 15 degrees.

13. The stirrup of claim 10, further comprising:

a casing covering at least a portion of the stirrup.

14. The stirrup of claim 10, wherein the stirrup is suspended from a strap that is coupled to the cross-member, the strap coupling the stirrup to the saddle, and when suspended from the strap, a bottom end of the stirrup lists toward a second similarly configured stirrup suspended from a second strap coupled to an opposite side of the saddle.

15. The stirrup of claim 10, wherein the tread includes one or more traction features on a top surface thereof.

* * * * *